United States Patent [19]

Fontana, Jr. et al.

[11] 4,299,680

[45] Nov. 10, 1981

[54] METHOD OF FABRICATING MAGNETIC BUBBLE MEMORY DEVICE HAVING PLANAR OVERLAY PATTERN OF MAGNETICALLY SOFT MATERIAL

[75] Inventors: Robert E. Fontana, Jr.; David C. Bullock; Shalendra K. Singh, all of Dallas; John M. Bush, Plano, all of Tex.

[73] Assignee: Texas Instruments Incorporated, Dallas, Tex.

[21] Appl. No.: 108,888

[22] Filed: Dec. 31, 1979

[51] Int. Cl.[3] ..... C23C 15/00; C23F 1/02

[52] U.S. Cl. ..... 204/192 E; 156/643; 156/661.1; 156/656; 427/131; 365/32; 365/39

[58] Field of Search ..... 204/192 E, 192 EC; 156/643, 661.1, 656, 657; 427/131; 365/39, 32; 29/604

[56] References Cited

U.S. PATENT DOCUMENTS

| | | | |
|---|---|---|---|
| 3,957,552 | 5/1976 | Ahn et al. | 427/131 X |
| 4,098,917 | 7/1978 | Bullock et al. | 427/36 |
| 4,172,758 | 10/1979 | Bailey et al. | 156/643 |
| 4,187,553 | 2/1980 | Ahn et al. | 365/8 |
| 4,226,691 | 10/1980 | Cunningham | 204/192 E |

*Primary Examiner*—Aaron Weisstuch
*Attorney, Agent, or Firm*—William E. Hiller; Melvin Sharp; James T. Comfort

[57] ABSTRACT

Method of fabricating a magnetic bubble memory device in which the magnetizable upper overlay pattern of magnetically soft material, e.g. permalloy, defining bubble propagation elements and bubble function-determining components as located above a bubble-supporting magnetic film is disposed in a wholly planar configuration to avoid bubble propagation anomalies encountered with typical non-planar overlay patterns of magnetically soft material. The fabrication method provides for the consecutive deposition onto a substrate having a magnetic film capable of supporting magnetic bubbles of a layer of non-magnetic electrically conductive material, a layer of insulating material, and a layer of magnetically soft material, such as permalloy. Patterning of the layers then proceeds from the uppermost layer downwardly in stages to form magnetically soft components defining the elements of magnetic bubble propagation paths and magnetic bubble function-determining components as a planar upper overlay pattern from the layer of magnetically soft material, insulation spacers from the layer of insulating material, and control conductors as a planar lower overlay pattern from the layer of non-magnetic electrically conductive material. Patterning of the respective layers is preferably achieved by ion milling of selected portions of the layer of magnetically soft material as defined by a first mask and by sequential plasma etching of selected portions of the underlying layer of insulating material and the layer of non-magnetic electrically conductive material as defined by a second composite mask partially comprising the overlay pattern of magnetically soft material and photoresist material.

15 Claims, 28 Drawing Figures

METHOD OF FABRICATING MAGNETIC BUBBLE MEMORY DEVICE HAVING PLANAR OVERLAY PATTERN OF MAGNETICALLY SOFT MATERIAL

BACKGROUND OF THE INVENTION

This invention relates to a method of fabricating a magnetic bubble memory device in which the patterned layer of magnetically soft material defining bubble propagation path elements and bubble function-determining components is disposed in a planar configuration, and to magnetic bubble memory structures resulting therefrom. More particularly, the fabrication method in accordance with this invention involves the consecutive deposition onto a substrate having a bubble-supporting magnetic film, of a plurality of layers of differing materials including a layer of non-magnetic electrically conductive material, a layer of insulating material, and a layer of magnetically soft material, and thereafter patterning each of the respective layers in a top-down sequence beginning with the uppermost layer and continuing downwardly in forming an upper patterned metal layer of magnetically soft material defining elements of the magnetic bubble propagation paths and bubble function-determining components, insulation spacers, and a lower patterned metal layer of non-magnetic electrically conductive material defining control conductors. In the completed magnetic bubble memory device, the patterned planar layer of magnetically soft material is uniformly spaced above the bubble-supporting magnetic film, thereby contributing to uniformity in the magnetic field strengths induced under each of the magnetically soft elements defined in the patterned layer of magnetically soft material.

A magnetic bubble memory device comprises a substrate of non-magnetic material on which a planar film or layer of magnetic material capable of supporting magnetic bubbles is disposed. The magnetic bubbles are caused to travel along predetermined paths within the layer of bubble-supporting magnetic material by laying down a magnetizable bubble propagation path pattern above the layer of magnetic material as a series of thin film propagation elements of magnetically soft material, e.g. permalloy, in the form of tiny geometric shapes or circuit elements. A magnetic drive field is provided within the plane of the layer of magnetic material and is rotated to cause the individual propagation elements included in the bubble propagation path pattern to be sequentially polarized in a cyclical sequence causing the individual bubbles to be propagated in a step-wise movement along the path as defined by the magnetizable propagation elements. One such overlay pattern commonly employed in a magnetic bubble memory device is the so-called asymmetric chevron pattern wherein individual propagation elements may take the form of asymmetric chevron permalloy structures. Another such overlay pattern is the so-called series of alternating T-shaped and bar-shaped permalloy elements. The overlay pattern of magnetically soft material is typically organized into a storage section comprising one or more memory storage loops, each of which has a plurality of bit positions for accommodating magnetic single-walled domains or bubbles which respectively represent one bit of binary information. Thus, information in the form of a series of magnetic bubbles and voids respectively representing binary "1's" and "0's" may be disposed in the respective memory storage loops for rotation thereabout in a synchronized and controlled manner to enable access to the stored information imparted thereby to be obtained. The memory storage section may be organized as a plurality of minor storage loops associated with a major storage loop, wherein the data information represented by magnetic bubbles and voids is transferred between the major loop and each of the respective minor loops, thereby enabling information to be read from the memory and to be written into the memory. In another form of magnetic bubble memory device architecture, the memory storage loops may be disposed between input and output sections such that information may be written into the storage loops via transfer gates interposed between the respective storage loops at one end thereof and a propagation path included in the input section, while information may be read out from the storage loops via output replicate gates to a propagation path included in the output section to provide non-destructive readout of data by replicating respective bubbles in the storage loops as these bubbles as being directed onto the propagation path in the output section for subsequent sensing by a bubble detector and erasure by an annihilator.

Heretofore, typical fabrication practices in constructing a magnetic bubble memory device have produced offset portions or "steps" in the overlay pattern of magnetically soft material which includes individual bubble propagation path elements defining the bubble propagation paths within the bubble-supporting magnetic film therebeneath and the bubble function-determining components, such as generators, replicators, annihilators and transfer gates, for example. This offset configuration occurs in areas of the overlay pattern of magnetically soft material which are disposed above a lower metallization level comprising an overlay pattern of non-magnetic electrically conductive material disposed above the bubble-supporting magnetic film but separated from the overlay pattern of magnetically soft material by insulating material. In this respect, the first or lower overlay pattern of non-magnetic electrically conductive material defines control conductors which extend beneath bubble function-determining components, such as generators, replicators, annihilators and transfer gates. The conventional fabrication technique provides for laying down insulating material, such as silicon dioxide, to cover the first level metallization comprising the overlay pattern of non-magnetic electrically conductive material, followed by the deposition of the second or upper metallization layer comprising the layer of magnetically soft material which is subsequently patterned. The presence of the lower overlay pattern of non-magnetic electrically conductive material and the covering body of insulating material causes the deposition of the layer of magnetically soft material to assume a non-planar configuration including offset portions in each of the areas overlying control conductors defined by the lower overlay pattern of non-magnetic electrically conductive material.

In order to increase data bit density per unit area in a magnetic bubble memory chip, it would be desirable to reduce the size of the magnetic bubbles and the bubble circuit period. In this connection, magnetic bubble memory chips have been operated with magnetic bubbles of five micron size, where the bubble function-determining components as defined by the upper non-planar overlay pattern of magnetically soft material have operated in a reliable manner in propagating bubbles in guided paths about the bubble-supporting magnetic film of the memory chip. In this instance, the transfer gates between the bubble storage section and a major propagation path to exchange data in the form of chains of magnetic bubbles and voids and the output replicate gates between the bubble storage section and a major propagation path for non-destructive readout of data, although being of non-planar configuration by virtue of the fabrication method employed in constructing the magnetic bubble memory chip have performed in a satisfactory manner. However, continuing efforts to reduce the bubble circuit period, as from the 12–16 μm range typically employed to the 6–8 μm period range enabling the use of bubbles having a size of 2 microns have encountered problems insofar as the reliable operation of the transfer gates and output replicate gates are concerned because of the heightened effect of bubble propagation anomalies induced by the step coverage of the magnetically soft material over the non-magnetic, electrically conductive control conductors brought about by the shrinkage in the bubble circuit period. With such reduced bubble circuit periods in a magnetic bubble memory device fabricated by a conventional non-planar process, transfer gate regions and output replicate gate regions as defined by non-planar portions of permalloy have produced sporadic results introducing serious reliability factors into the operation of such magnetic bubble memory devices.

To this end, a number of so-called planar fabrication processes have been developed to eliminate the non-planar character of the gate regions as defined by the upper overlay of magnetically soft material. These planar processes generally involve piece-meal processing from the lower metallization level upwardly, wherein the non-magnetic electrically conductive overlay pattern is first accomplished to define the control conductors and the respective leads, subsequently followed by the deposition and patterning of the upper metallization level of magnetically soft material over a body of insulation material covering the lower patterned metallization level and filling the voids therein. Such so-called planar processes suffer from the disadvantage of restrictions being placed on the geometry reductions which might be accomplished, since a substantial portion of the patterning complexity exists in the upper metallization layer of magnetically soft material. In an effort to attack this small geometry resolution problem, a top-down planar process has been previously suggested in which a sandwich structure of individual planar layers including a first layer of insulation material, a layer of non-magnetic electrically conductive material, a second layer of insulation material, and a layer of magnetically soft material is disposed on the bubble-supporting magnetic film, followed by patterning of the upper planar layer of magnetically soft material and subsequent patterning of the second layer of insulation material and the layer of non-magnetic electrically conductive material. This top-down planar process attempted to employ a double density photoresist mask so as to provide different thicknesses of photoresist over the permalloy and control conductor elements. Although control conductor metal is produced by such a process beneath the permalloy elements defined in the planar overlay pattern forming the upper metallization layer, efforts to develop a magnetic bubble memory device which could operate successfully when fabricated in this manner have heretofore produced inconsistent and generally unsatisfactory results.

SUMMARY OF THE INVENTION

In accordance with the present invention, an improved top-down planar process of fabricating a magnetic bubble memory device having a planar overlay pattern of magnetically soft material as an upper metallization level is provided. Initially, the method requires respective layers of non-magnetic electrically conductive material, insulating material, and magnetically soft material to be consecutively deposited onto a substrate having a magnetic film capable of supporting magnetic bubbles. Thereafter, patterning of the respective deposited layers proceeds from the uppermost layer downwardly. Two separate masks are employed in the sequential patterning procedure, one such mask being used in the patterning of the upper planar overlay of magnetically soft material, and the second such mask being used in the subsequent patterning of the underlying layers of insulating material and non-magnetic electrically conductive material. The patterning of the upper planar overlay of magnetically soft material is accomplished by ion milling which etches away selected portions of the magnetically soft material to produce a pattern in the remaining portions of the magnetically soft material. Patterning of the underlying layer of insulation material and the layer of non-magnetic electrically conductive material is accomplished by employing a second mask, and subjecting the exposed regions of the layer of insulating material to a selective plasma etch to selectively remove these exposed regions, and sequentially following with a different selective plasma etch to remove the corresponding underlying regions of the non-magnetic electrically conductive material down to the level immediately beneath the layer of non-magnetic electrically conductive material.

The layer of non-magnetic electrically conductive material may be suitably formed from an aluminum-copper (AlCu) alloy directly contacting the bubble-supporting magnetic film, where plasma etching is employed as the means for patterning the non-magnetic electrically conductive layer. In this connection, the AlCu layer must be of minimum thickness for stability, such as approximately 3000 Å and must be insulated from the upper planar layer of magnetically soft material, e.g. permalloy. Where it is contemplated that the magnetic bubble memory device is to be constructed with a geometry size accommodating bubbles of 2μ size, the memory device will exhibit greater reliability in its operation when the upper planar patterned permalloy layer is situated as close as possible to the surface of the bubble-supporting magnetic garnet film. A space of approximately 5000 Å between the upper patterned overlay of permalloy and the surface of the magnetic film has been determined as being optimum for 2μ bubble operation by facilitating an effective magnetic coupling between the spaced upper overlay pattern of permalloy and the bubble-supporting magnetic film.

The resulting magnetic bubble memory structure has upper and lower metallization levels with insulating material therebetween, wherein the lower metallization level comprises a patterned planar overlay of AlCu material defining control conductors and underlying the entire surface area of the upper metallization level which comprises the planar overlay of patterned permalloy. Thus, the planar transfer gate regions and planar output replicate gate regions of reduced geometry size operate reliably when the underlying control conductors defined by the lower metallization level of non-magnetic electrically conductive material are selectively subjected to current pulses. All of the permalloy elements are spaced a uniform distance above the planar surface of the bubble-supporting magnetic film, but are actually closer thereto than in magnetic bubble memory structures of conventional character, since the layer of insulating material between the non-magnetic electrically conductive layer and the bubble-supporting magnetic film can be eliminated which has the additional advantage of enabling the AlCu comprising the non-magnetic electrically conductive layer to be made thicker, approximating 3000 Å for stability.

The magnetic bubble memory structure by having the upper overlay pattern of magnetically soft material arranged in a planar configuration avoids bubble propagation anomalies typically accompanying structures in which the upper overlay pattern of magnetically soft material includes stepped portions in areas defining transfer gate regions and output replicate gate regions. Additionally, the fabrication method in accordance with the present invention is better suited to smaller geometry bubble propagation elements and function-determining components, since the significant patterning complexity is found in the upper overlay pattern of magnetically soft material such that top-down patterning as contemplated by the present method achieves improved pattern resolution. Further, the patterned planar overlay of magnetically soft material itself serves as an alignment mask for the subsequent patterning procedures involving the layers lying therebeneath.

In a more specific aspect of this invention, the fabrication method contemplates the use of a composite second mask for the sequential patterning of the layers of insulating material and non-magnetic electrically conductive material underlying the planar overlay pattern of magnetically soft material, wherein the second patterning mask is partially formed by portions of individual elements of magnetically soft material from the planar overlay pattern thereof cooperating with a patterned layer of photoresist material, with the mask-defining boundary portions afforded by the magnetically soft elements included in the planar overlay pattern aiding alignment in connection with the patterning of the non-magnetic electrically conductive layer. In the latter respect, the use of the composite second mask enables some degree of tolerance in misalignment of the pattern in the photoresist material in that critical dimensions in the gapping or spacing between control conductors defined in the patterned non-magnetic electrically conductive layer may be determined solely by the elements of magnetically soft material included in the composite second mask, rather than the patterned photoresist material.

The fabrication method produces a magnetic bubble memory device in which the lower planar overlay pattern of non-magnetic electrically conductive material underlies the entire surface area of the upper planar overlay pattern of magnetically soft material and is separated therefrom by spacer portions of insulating material from the patterned layer of insulating material interposed therebetween. The individual control conductors in the overlay pattern of non-magnetic electrically conductive material include input and return spaced conductor members integrally connected to each other at only one end thereof to define a hairpin loop, with the input and return conductor members underlying respective different bubble propagation elements of the planar overlay pattern of magnetically soft material which are spaced from each other, thereby allowing a current path for an energy pulse applied to the input conductor member of each control conductor in selectively energizing bubble function-determining components, such as transfer gates and replicate output gates, for example.

DETAILED DESCRIPTION

Figure 1:
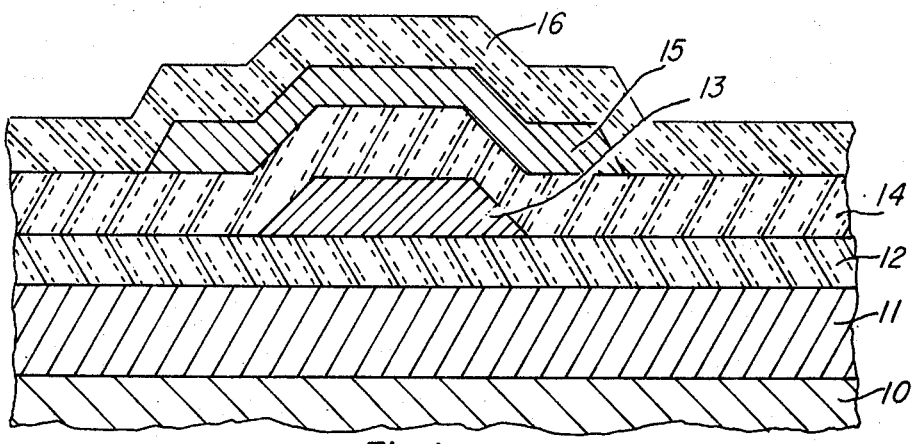
Fig. 1 (PRIOR ART)
FIG. 1 is a cross-sectional view illustrating a portion of a magnetic bubble memory device as fabricated in accordance with a conventional method, wherein the upper metallization level of magnetically soft material is of non-planar configuration, including offset portions or steps.

Referring more specifically to the drawings, FIG. 1 illustrates a cross-section of a typical magnetic bubble memory device as fabricated in accordance with a conventional non-planar method, wherein a stepped configuration is imparted to the upper metallization level comprising the overlay pattern of magnetically soft material. The magnetic bubble memory device of known structure as depicted in FIG. 1 comprises a non-magnetic substrate 10 on which a planar bubble-supporting magnetic film or layer 11 possessing a uniaxial anisotropy is disposed. Typically, the non-magnetic substrate 10 is a non-magnetic rare earth garnet, gadolinium gallium garnet (GGG) for example, and the film or layer 11 is an epitaxially deposited garnet layer, e.g. $(YSmCaLu)_3(FeGe)_5O_{12}$ of the order of about 2 microns in thickness (20,000 Å) for use with magnetic bubbles of 2 microns in diameter and having an easy magnetization in a direction perpendicular to the plane of the layer. Other materials suitable as the epitaxially grown layer of bubble-supporting magnetic material and which may have a thickness range of the order of 1–10 microns include: $(YSm)_3(FeGa)_5O_{12}$, $(YGdTm)_3(FeGa)_5O_{12}$, $(YEuYb)_3(FeAl)_5O_{12}$, $(YGdYb)_3(FeGa)_5O_{12}$, $(YEu)_3Fe_5O_{12}$, $(LuSm)_3Fe_5O_{12}$, $(YGd)_3Fe_5O_{12}$ and $(YSmCa)_3(FeGe)_5O_{12}$.

A multi-level assembly is formed on the planar magnetic film 11 including patterned first and second metallization layers, with insulation layers respectively interposed between the patterned first metallization layer and the magnetic film 11 and between the first and second patterned metallization layers. To this end, a magnetic bubble memory device as conventionally fabricated in the manner illustrated in FIG. 1 includes a first insulation layer 12, such as silicon dioxide, disposed on the magnetic film 11. The first or lower metallization layer 13 is of non-magnetic electrically conductive material and is patterned to define control conductors and component parts of bubble function-determining structures. A second layer 14 of insulating material, such as silicon dioxide, is disposed over the patterned first metallization layer 13, and the second or upper metallization layer 15 which comprises an overlay pattern of magnetically soft material, such as permalloy, is disposed on the second insulation layer 14 in spaced relationship to the patterned first metallization layer 13. A passivation layer 16 of insulation material, such as silicon dioxide, is disposed over the patterned upper metallization level 15 of permalloy to complete the basic magnetic bubble device structure. In regions where the control conductors defined by the patterned first metallization level 13 underlie portions of the upper metallization level 15 of magnetically soft material, the conventional fabrication technique of depositing a respective layer of material, patterning the layer, and then depositing another layer of a different material for subsequent patterning and so forth causes build-ups of layered material in regions where the first or lower overlay pattern 13 exists, thereby leading to a stepped or off-set configuration for the upper overlay pattern 15 of magnetically soft material defining the individual bubble propagation path elements and bubble function-determining components, such as transfer gates and output replicate gates. The non-planar configuration of the overlay pattern 15 of magnetically soft material overlying portions of the lower metallization level 13 of patterned non-magnetic electrically conductive material defines transfer gate regions and output replicate gate regions in which different portions of the overlay pattern 13 of magnetically soft material are spaced different distances from the planar surface of the magnetic film 11, thereby leading to magnetic field anomalies. Attempts to shrink the geometry of the individual bubble propagation path elements and bubble function-determining components as defined by the overlay pattern 15 of magnetically soft material have heightened the effect of the bubble propagation anomalies created by the differences in the space between portions of the overlay pattern 15 of magnetically soft material and the surface of the magnetic film 11. In particular, the operation of transfer gates and output replicate gates in magnetic bubble memory devices having a reduced bubble circuit period to enable the use of bubbles having a size of 2 microns where step coverage of the overlay pattern 15 of magnetically soft material is present has been subject to questionable reliability because of the varying results achieved thereby.

In accordance with the present invention, the method of fabricating a magnetic bubble memory device as contemplated herein avoids the step coverage of the overlay pattern of magnetically soft material, instead forming this overlay pattern in a planar configuration, thereby eliminating bubble propagation anomalies encountered in the operation of a magnetic bubble memory device as constructed in accordance with FIG. 1. To this end, the method according to the present invention may be described as a top-down planar process in that a sequence of respective layers are consecutively deposited onto the bubble-supporting magnetic film 11 which is disposed on the non-magnetic substrate 10. The consecutive deposition includes at least a layer of non-magnetic electrically conductive material 17 which may be deposited directly onto the bubble-supporting magnetic film 11, followed by the deposition of a layer of insulating material 18, and a layer of magnetically soft material 19 in that order. The non-magnetic electrically conductive material of the layer 17 may be suitably an alloy of aluminum-copper (AlCu), the insulating material of the layer 18 may be silicon dioxide, and the magnetically soft material of the layer 19 may be permalloy.

Patterning of the individual deposited layers 17, 18 and 19 then proceeds from the top downwardly, thereby achieving a planar overlay pattern for the uppermost layer 19 of magnetically soft material in contrast to the conventional fabrication procedure, which produces a non-planar overlay pattern 15 of magnetically soft material as illustrated in FIG. 1. The top-down planar process herein described is a two mask process, wherein a first patterned mask is relied upon for patterning the upper layer 19 of magnetically soft material, and a second patterned mask which partially relies upon the planar patterned overlay 19 of magnetically soft material as previously formed is employed for the subsequent patterning of the layer of insulating material 18 and the layer of non-magnetic electrically conductive material 17.

Figure 3:
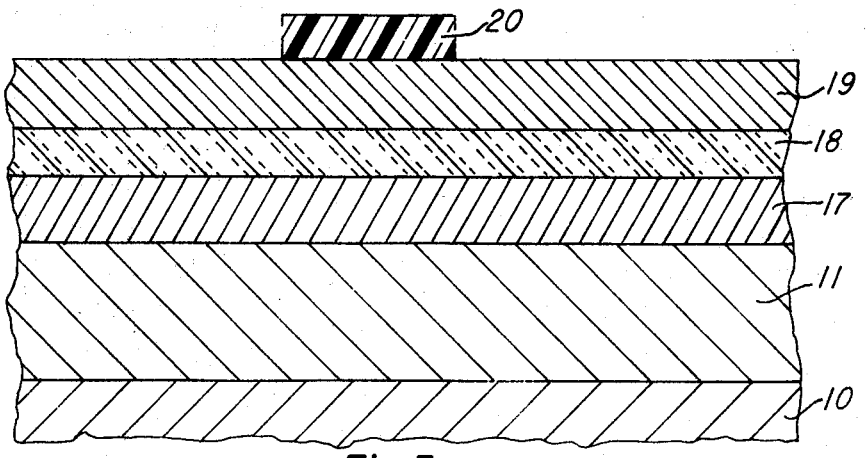

Referring now to FIG. 3, in patterning the upper layer 19 of magnetically soft material (i.e. permalloy), a layer 20 of photosensitive material, (i.e. photoresist), is deposited onto the layer 19 of magnetically soft material. The photoresist layer 20 is then exposed to a suitable energy source, such as ultraviolet light in a typical photolithographic procedure, the exposure being selective in accordance with a predetermined pattern to be subsequently formed in the layer 19 of permalloy. Suitable energy sources for this purpose, include in addition to ultraviolet light, X-rays, and E-beam exposure, wherein the solubility of selected portions of the photoresist layer 20 is changed with respect to the solubility of the remaining portions of the photoresist layer 20 not exposed to the energy source. A latent image conforming to the desired pattern is provided in the photoresist layer 20, and upon developing the photoresist layer 20 with solvents in the usual manner, a pattern is formed by the removal of the more soluble portions of the photoresist layer 20, thereby exposing selected regions of the layer 19 of permalloy, as illustrated in FIG. 3.

Figure 4:
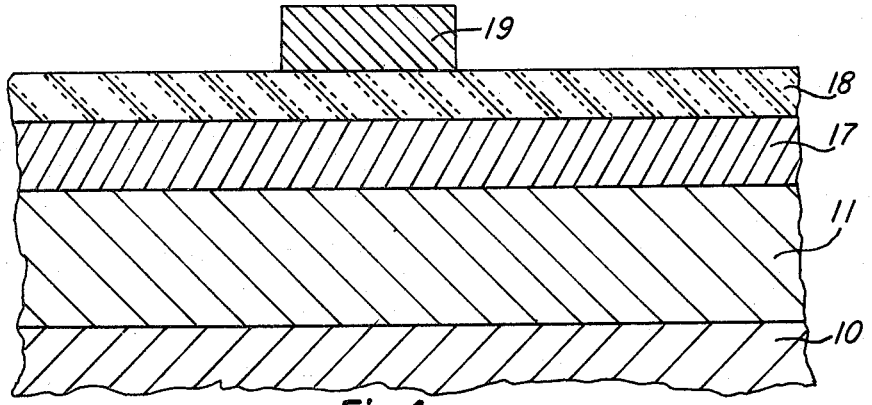

The assembly is then subjected to an etching procedure, preferably ion milling, to define the pattern in the layer 19 of permalloy. The ion milling treatment induces rapid etching of the exposed regions of the permalloy layer 10 and is continued until the exposed portions of the permalloy layer 19 have been removed, thereby exposing corresponding regions in the underlying layer 18 of insulating material. The residual portion of the patterned mask provided by the developed photoresist layer 20 is then removed by a suitable stripping procedure. The resulting structure now assumes the form illustrated in FIG. 4. Although the patterning of the permalloy layer 19 has been described in connection with the use of a photoresist mask, it is contemplated that the patterning of the permalloy layer 19 may be accomplished by the use of other masking techniques, such as the method described in U.S. Pat. No. 4,098,917 to Bullock et al issued July 4, 1978 in which an in-situ metal mask is first formed by photolithographic techniques employing a patterned layer of photoresist material and serves as the medium for patterning the underlying permalloy layer via ion milling. Ion milling is accomplished by the use of accelerated ions striking the selectively exposed regions of the surface of the layer 19 of magnetically soft material at insufficient energy levels to be implanted such that the ions bounce off the surface and cause erosion thereof. A collimated beam of argon ions at 1 Kev and a pressure of $2\times10^{-4}$ torr may be employed in patterning the layer 19 of permalloy.

Figure 5:
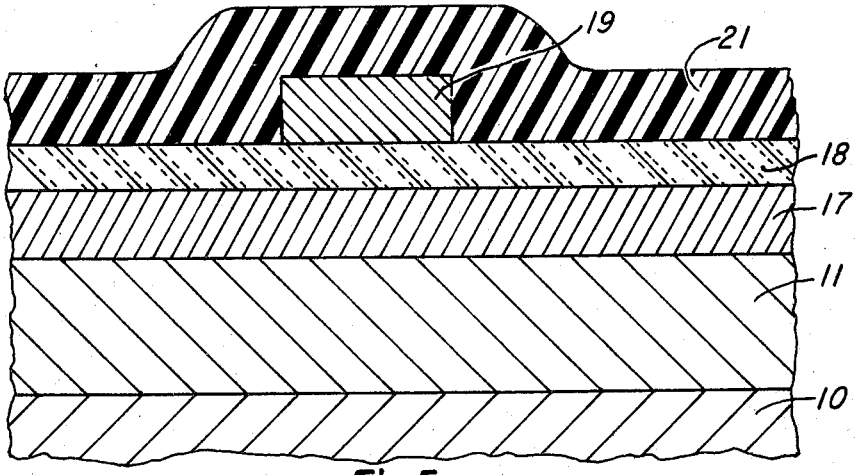
Figure 6:
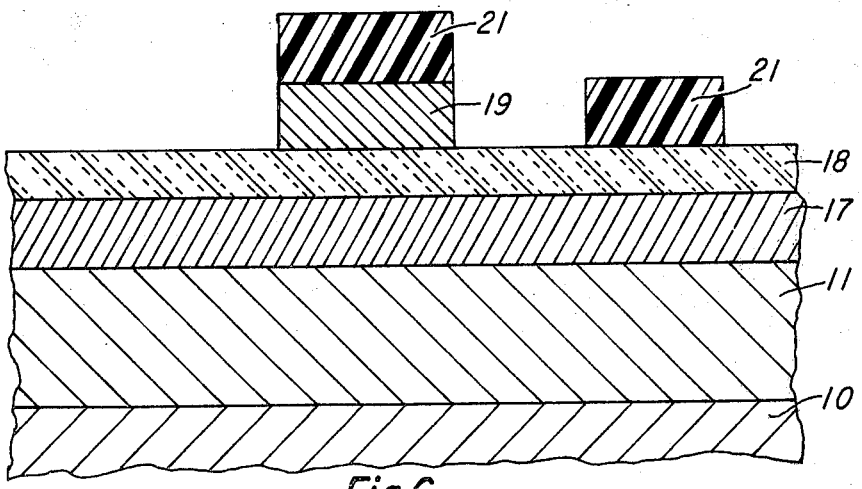

Patterning of the layer 18 of insulating material and the layer 17 of non-magnetic electrically conductive material now proceeds in sequence by providing a second composite mask in which portions of the previously patterned layer 19 of magnetically soft material are utilized as part of the second patterning mask as an alignment aid for accurately defining critical gaps or spaces in the pattern imparted to the lower metallization level 17 of non-magnetic electrically conductive material. In performing this subsequent patterning procedure for the layer 18 of insulating material and the layer 17 of non-magnetic electrically conductive material, a layer 21 of photosensitive material, i.e. photoresist, is deposited onto the patterned layer 19 of magnetically soft material and the exposed portions of the layer 18 of insulating material. FIG. 5 illustrates this stage of the fabrication method. Thereafter, the photoresist layer 21 is exposed selectively to a suitable energy source in accordance with the pattern to be subsequently formed in the layer 18 of insulating material and the layer 17 of non-magnetic electrically conductive material. As previously described in connection with the selective exposure and development of the photoresist layer 20, the latent image formed in the photoresist layer 21 by its selective exposure to the energy source is developed with appropriate solvents, and a pattern is formed therein by the removal of the more soluble portions of the photoresist layer 21 to form a second mask, wherein the planar overlay pattern 19 of the magnetically soft material forming the upper metallization level acts as an alignment aid for subsequent patterning of the layer 18 of insulating material and the layer 17 of non-magnetic electrically conductive material disposed therebeneath. FIG. 6 depicts this stage of the fabrication method, wherein the second mask has been defined for patterning in sequence the underlying layers 18, 17 of insulating material and non-magnetic electrically conductive material, respectively.

Figure 7:
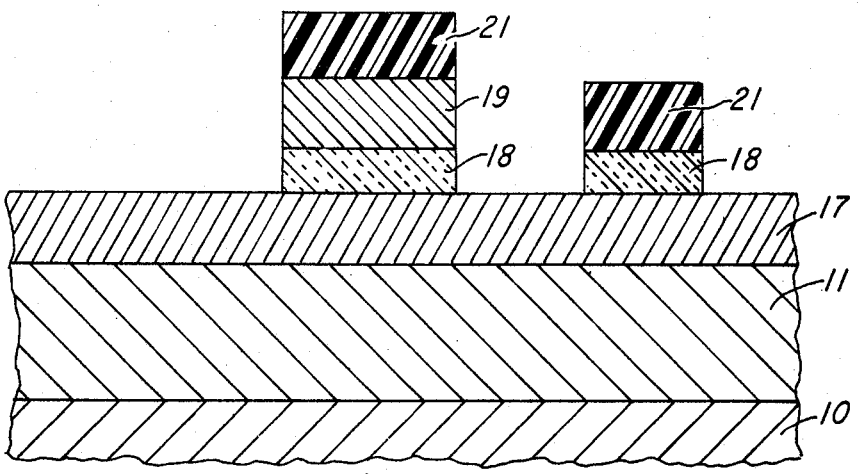

FIG. 7 illustrates the patterning of the layer 18 of insulating material, wherein the layer 18 has been subjected to an etching procedure to remove the exposed regions thereof, while the second mask provided by the patterned photoresist layer 21 and in part by the patterned planar overlay 19 of magnetically soft material protects the underlying portions of the layer 18 of insulating material. Preferably, plasma etching is relied upon for selectively removing the exposed portions of the layer 18 of insulating material down to the level of the layer 17 of non-magnetic electrically conductive material. The etchant atmosphere employed for plasma etching the silicon dioxide layer 18 may be provided from a suitable fluorocarbon etch, one such oxide etch being $C_2F_6$ in a mixture of argon. This etchant mixture is isotropic and selective in its etchant characteristics in that it has no appreciable effect on permalloy which is the material of the layer 19 of magnetically soft material or on the aluminum-copper alloy of the non-magnetic electrically conductive layer 17.

Figure 8:
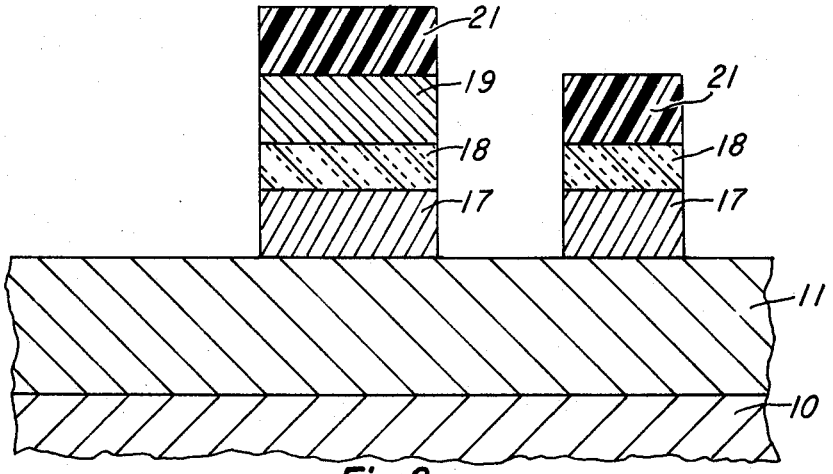

Thereafter, patterning of the underlying layer 17 of non-magnetic electrically conductive material (i.e. AlCu) is begun, preferably by plasma etching but utilizing a different etchant atmosphere than that during the patterning of the silicon dioxide layer 18. The same composite mask including elements of the permalloy layer 19 is employed for patterning the non-magnetic electrically conductive layer 17 which preferably is made of an aluminum-copper alloy. In this instance, the plasma etchant atmosphere is provided by a chemical mixture which is selective to the aluminum-copper alloy material, but has no measurable etchant effect on either the silicon dioxide material of the patterned layer 18 or the permalloy material of the patterned layer 19. Additionally, the etchant reagent for plasma etching of the aluminum-copper alloy layer 17 is selected so as to have no effect on the surface of the bubble-supporting magnetic layer 11, thereby producing no degradation thereof. Preferably, the plasma etching of the aluminum-copper alloy layer 17 is accomplished by an etchant atmosphere of silicon tetrachloride, $SiCl_4$, such as is disclosed in pending U.S. Pat. application, Ser. No. 930,453 filed Aug. 2, 1978, abandoned in favor of continuation U.S. Pat. application, Ser. No. 167,973 filed July 14, 1980. This plasma etch is selective in its etching action to the aluminum-copper alloy layer 17 and does not attack the magnetic garnet bubble-supporting film 11, or the previously patterned silicon dioxide layer 18 and the permalloy layer 19. FIG. 8 illustrates this stage in the fabrication method, it being noted that areas of the aluminum-copper alloy layer 17 are produced by the patterning for connection to a voltage source for imparting current pulses thereto in the operation of the magnetic bubble memory device, these regions of the patterned aluminum-copper alloy layer 17 having no corresponding region of permalloy material from the layer 19 disposed thereabove. One such area of the AlCu patterned layer 17 with accompanying overlying oxide portion 18 and photoresist portion 21 is shown in FIG. 8.

Figure 9:
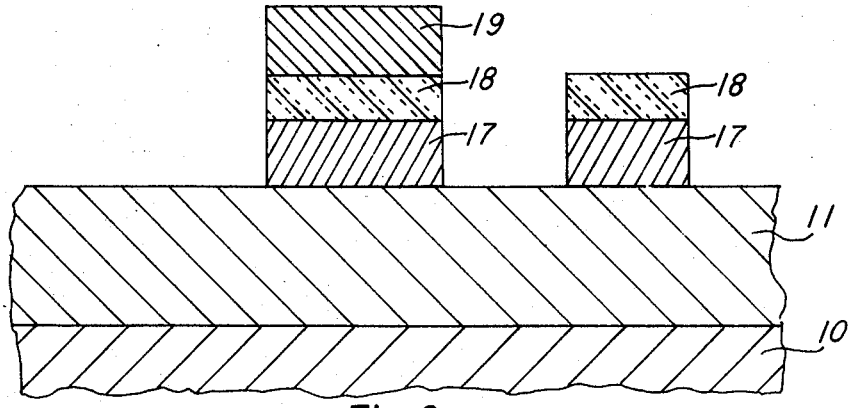
Figure 10:
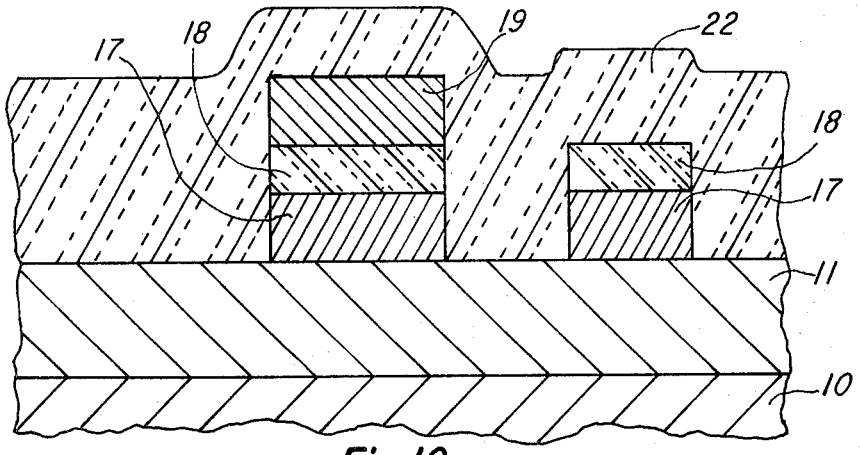

As shown in FIG. 9 any remaining portions of the layer 21 of photoresist material included in the second composite mask are then stripped from the structure by a suitable etching procedure, such as an ashing technique. Thereafter, a passivation layer 22 of insulation material, such as silicon dioxide, is grown on the bubble-supporting magnetic garnet layer 11 so as to cover the patterned upper overlay 19 of permalloy and the patterned lower overlay of aluminum-copper alloy material 17 as disposed therebeneath, being insulated therefrom by the patterned layer 18 of silicon dioxide interposed therebetween. The passivation oxide layer 22 may be formed in any suitable manner, such as by depositing silicon dioxide on the structure from an atmosphere of silane ($SiH_4$) and carbon dioxide, thereby resulting in the structure shown in FIG. 10.

Figure 11:
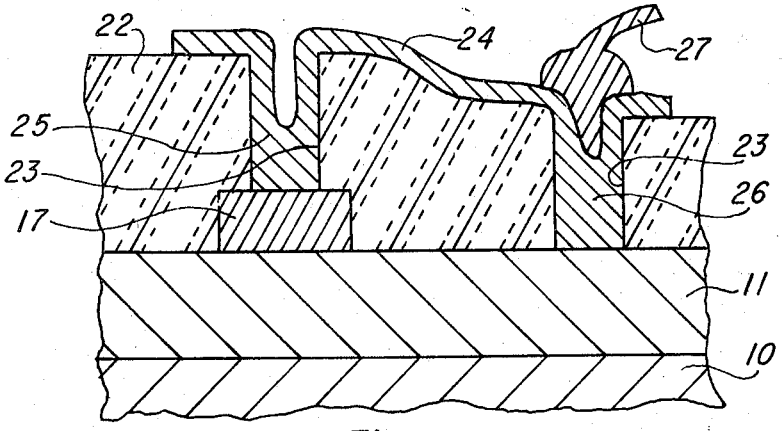
FIG. 11 is a cross-sectional view illustrating the electrical contact connection to the overlay pattern of non-magnetic electrically conductive material defining control conductors for the magnetic bubble memory device in accordance with the present invention.

Following the deposition of the passivation oxide layer 22, through vias or holes 23 are formed in the passivation layer 22 so as to extend therethrough into contact with the patterned lower metallization level 17 of aluminum-copper alloy material and into communication with the surface of the magnetic garnet layer or film 11. These holes or through vias 23 may be formed by appropriate plasma etching of selected portions of the passivation layer 22 through a patterned layer of photosensitive material, i.e. photoresist. Thereafter, the metallic contact pads 24 are defined on the passivation layer 22 by depositing a metal layer of electrically conductive material thereon and defining the contact pads 24 by appropriate patterning. In this respect, the deposition of the contact pads 24 causes the metal thereof to be deposited in the through vias or holes 23 to form appropriate electrical contacts 25, 26 with the patterned lower metallization level 17 of non-magnetic electrically conductive material and with the surface of the magnetic garnet film 11, respectively. Preferably, the metal material of the contact pads 24 is a gold-chromium, AuCr, alloy. Electrical conductors 27 are then bonded to the respective contact portions 26 of the electrical contact pads 24, these bonding areas being separated from the permalloy material of the upper metallization level 19. Such a structure as illustrated in FIG. 11 prevents shorting of the permalloy detector region of the upper patterned metallization level 19 to the aluminum-copper alloy control conductor included in the lower patterned metallization level 17 which might otherwise occur during a probing or bonding operation.

Figure 2:
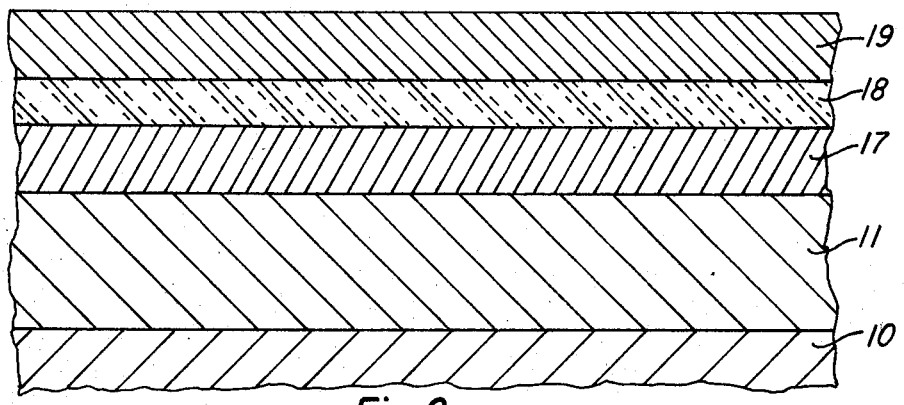
FIGS. 2–10 are cross-sectional views illustrating respective sequential stages in the method of fabricating a magnetic bubble memory device in accordance with the present invention, wherein a planar overlay pattern of magnetically soft material comprises the upper metallization level.
Figure 12:
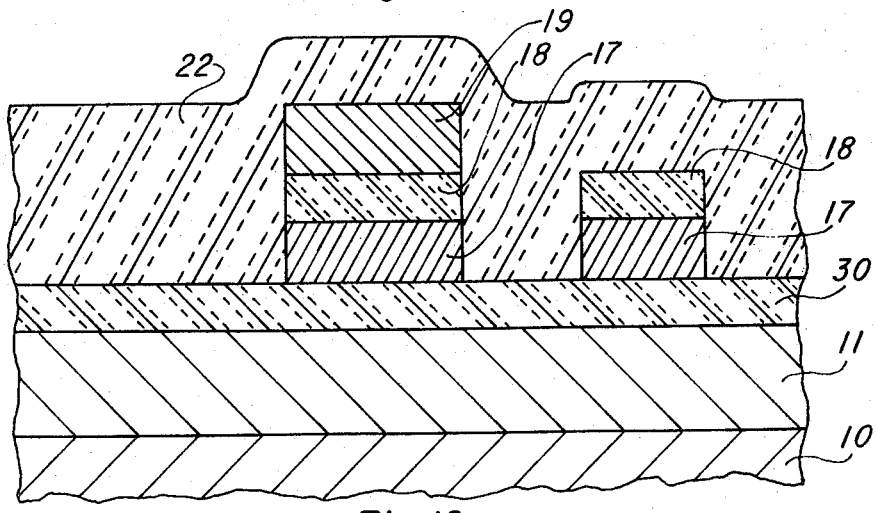
FIG. 12 is a cross-sectional view similar to FIG. 10, but illustrating the corresponding stage in another embodiment of the fabrication method, wherein a layer of insulating material is provided between the bubble-supporting magnetic film and the overlay pattern of non-magnetic electrically conductive material.

While the present fabrication method has been described in a preferred form, wherein the lower metallization level 17 of non-magnetic electrically conductive material is in direct contact with the magnetic garnet film 11, it will be understood that the present invention also contemplates the deposition of a first layer of insulating material 30, such as silicon dioxide, in the consecutive deposition of layers onto the magnetic garnet film 11, wherein the first oxide layer 30 is interposed between the magnetic garnet film 11 and the non-magnetic electrically conductive layer 17 in the sandwich assembly of FIG. 2. Thereafter, the top-down processing proceeds as previously described, resulting in a magnetic bubble memory device as illustrated in FIG. 12, wherein the first oxide layer 30 covers the surface of the bubble-supporting magnetic garnet film 11 so as to space the patterned lower metallization level 17 of non-magnetic electrically conductive material therefrom. Where the first oxide layer 30 is deposited, the etching procedure employed to pattern the second oxide layer 18 and the underlying aluminum-copper layer 17 may be performed by ion milling or wet etching techniques, since the surface of the magnetic garnet film 11 is protected by the first oxide layer 30. It should be understood that in fabricating a magnetic bubble device for use with magnetic bubbles of two micron size, the upper metallization level 19 of permalloy material must be sufficiently close to the surface of the magnetic garnet film 11 to couple the permalloy to the garnet surface. A further requirement is that the aluminum-copper layer 17 must be of a minimum thickness for stability against undue stress caused by pulses of electrical current and must be insulated from the permalloy layer 19. These factors are best achieved by performing the fabrication method herein disclosed with the aluminum-copper layer in direct contact with the surface of the magnetic garnet film 11. The elimination of the first oxide layer 30 in the preferred embodiment of the fabrication method permits greater flexibility in the relative thicknesses of the upper and lower metallization levels, a factor which is especially important for magnetic bubble memory devices of reduced geometry size for 2 micron magnetic bubble operation. The space between the upper overlay pattern 19 of permalloy and the surface of the magnetic garnet film 11 should be about 5000 Å to achieve optimum coupling of the permalloy bubble propagation elements and function-determining components to the surface of the magnetic garnet film 11, thereby enhancing the operational reliability of the magnetic bubble memory device. The aluminum-copper alloy layer 17 which forms the control conductors for actuating the bubble function-determining components included in the upper overlay pattern 19 of permalloy must be of a minimum thickness for stability in accepting stresses induced by the passage of electrical current therethrough, approximately 3000 Å minimum thickness of the aluminum-copper alloy layer 17 being desirable. Thus, the spacer portions of oxide from the patterned oxide layer 18 between the permalloy and the aluminum-copper alloy overlays can be approximately 2000 Å in thickness.

Figure 13:
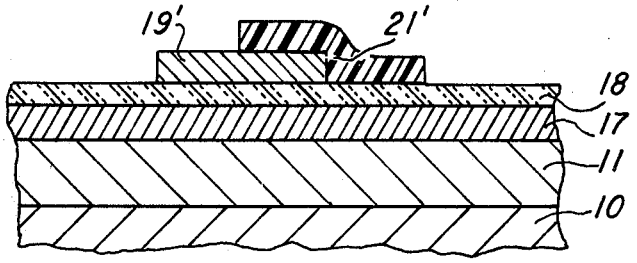
FIGS. 13–15 are cross-sectional views illustrating a more specific embodiment of the fabrication method in accordance with the present invention, wherein the second pattern mask involved in the sequential patterning of the layers of insulating material and non-magnetic electrically conductive material is defined in part by elements of the planar overlay pattern of magnetically soft material and a patterned photoresist layer arranged in off-set relationship on the planar overlay pattern of magnetically soft material.
Figure 14:
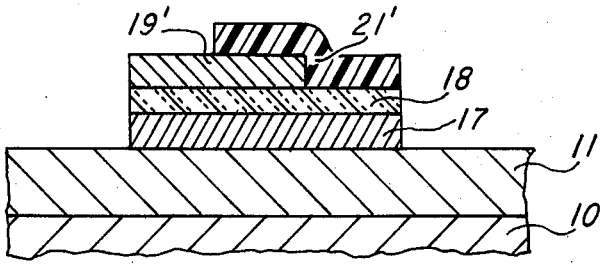
Figure 15:
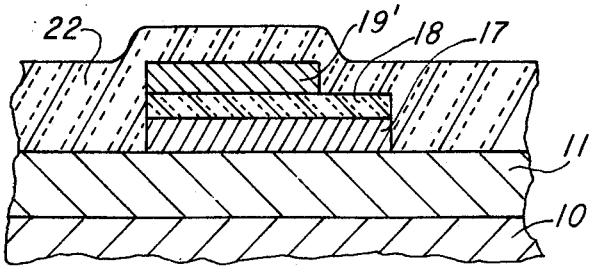

FIGS. 13–15 illustrate another aspect of the fabrication method, wherein the planar upper overlay pattern 19' of permalloy material is part of the second pattern mask employed for the sequential patterning of the layers 18, 17 of insulating material and non-magnetic electrically conductive material, respectively. FIG. 13 corresponds to the stage of the fabrication method illustrated in FIG. 6, wherein a second mask has been defined for patterning in sequence the insulation layer 18 and the non-magnetic electrically conductive layer 17 by appropriate plasma etching as earlier described. The second mask is of a composite character in that portions of the patterned upper overlay 19' of permalloy are included as part of the mask with a patterned photoresist layer 21' forming the remainder of the mask. In this respect, the photoresist layer 21' is patterned in an off-set relation to the patterned overlay 19' of permalloy such that the boundary-defining edges of the second composite mask are partly provided by the edges of the permalloy 19' and partly by the edges of the photoresist 21'. Thereafter, the fabrication method proceeds as described earlier in that the insulation layer 18 is first patterned by an appropriate plasma etch, following which the layer 17 of non-magnetic electrically conductive material is patterned by employing a different plasma etchant, this stage of the fabrication method being illustrated in FIG. 14. In the patterning of the insulation layer 18 and the subsequent patterning of the underlying layer 17 of non-magnetic electrically conductive material, pattern-defining edges of the upper overlay pattern 19' of permalloy provide alignment and masking of the underlying layers 18 and 17 of insulating material and non-magnetic electrically conductive material, respectively. The respective plasma etches are selective to the oxide layer 18 and the aluminum-copper alloy layer 17 and have no effect on the permalloy layer 19'. Thereafter, the passivation layer 22 of silicon dioxide is grown as before (FIG. 15).

Figure 16:
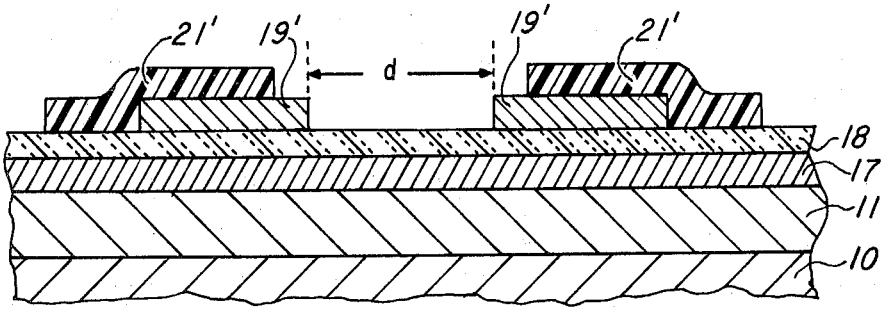
FIGS. 16–18 are cross-sectional views illustrating a further extension of the composite second mask patterning procedure of FIGS. 13–15, wherein respective elements of magnetically soft material included in the planar overlay pattern thereof are relied upon to define a critical gap or space to be formed in the underlying layer of non-magnetic electrically conductive material during the patterning thereof.
Figure 17:
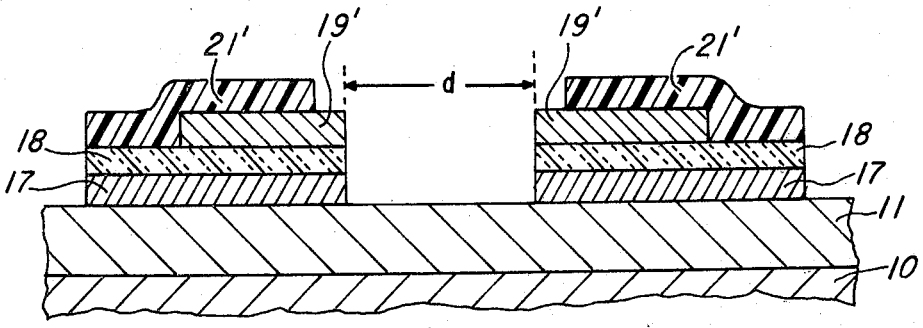
Figure 18:
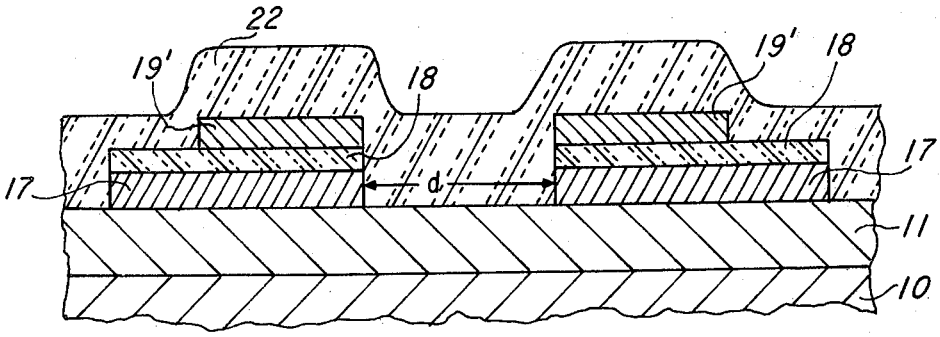

A further extension of this aspect of employing the patterned upper planar overlay 19' of permalloy with a patterned photoresist layer 21' as a composite second mask is illustrated in FIGS. 16–18 which respectively correspond to FIGS. 13–15, but show spaced permalloy portions 19' in the composite second mask being employed as a means of establishing a critical gap dimension d to be formed in the lower metallization level 17 of non-magnetic electrically conductive material during the patterning thereof to insure proper operation of adjacent control conductors defined by the patterned lower metallization level 17 in the completed magnetic bubble memory device. To this end, the original patterning of the upper metallization level 19' of permalloy is precisely controlled to insure that critical space relationships between adjacent permalloy portions are provided to enable these critical space dimensions to be subsequently imparted to the lower metallization level 17 of non-magnetic electrically conductive material during the patterning thereof at a later stage in the fabrication method. In this way, the aspect of the fabrication method illustrated in FIGS. 16–18 is tolerant of some misalignment in the patterning of the layer of photoresist material 21' as deposited over the upper planar overlay pattern 19' of permalloy and the exposed portions of the oxide layer 18. In this respect, it will be understood that the edges of the permalloy portions 19' included in the composite second mask are intended to define all critical gapped dimensions in the underlying non-magnetic electrically conductive layer 17 during its patterning and that the edges of the off-set patterned photoresist layer 21' will define the portions of the patterning in the underlying layers which can accept some misalignment within a tolerance range. Thus, in patterning the photoresist layer 21', the selective exposure of the photoresist layer to an energy source can accommodate some degree of misalignment with respect to the latent image formed therein and the subsequent development of the photoresist layer in producing the composite second mask, wherein portions of the mask are defined by off-set patterned photoresist material 21' and portions are defined by exposed edges of permalloy material included in the upper planar overlay pattern 19'. Accordingly, this aspect of the fabrication method enables accurate registration and controlled definition of the upper and lower metallization levels even though some misalignment in the patterning of the photoresist layer employed in the second composite mask may occur. Thus, the aspect of the fabrication method illustrated in FIGS. 16–18 in accordance with the present invention produces a magnetic bubble memory device having a planar upper overlay pattern of permalloy which is self-aligned with respect to the underlying lower patterned overlay of aluminum-copper alloy by employing the previously patterned permalloy to mask part of the aluminum-copper alloy layer during the patterning thereof.

Figure 19A:
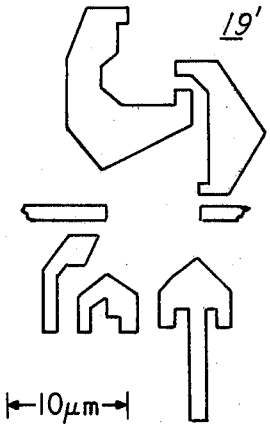
FIG. 19*a* is a fragmentary plan view of the planar overlay pattern of magnetically soft material comprising the upper metallization level.
Figure 19B:
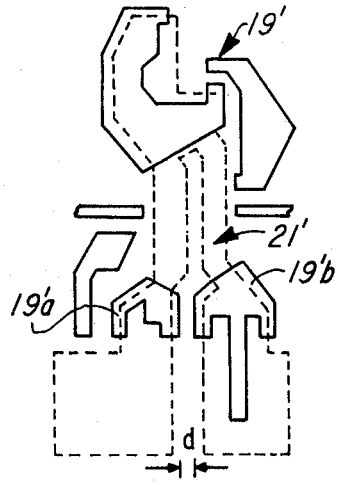
FIG. 19*b* is a fragmentary plan view of the planar overlay pattern of magnetically soft material shown in FIG. 19*a*, with the offset photoresist pattern employed therewith shown in dashed lines as a composite mask for patterning the non-magnetic electrically conductive material comprising the lower metallization level.
Figure 19C:
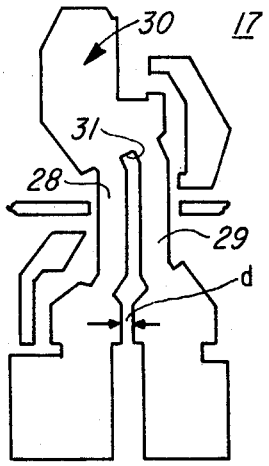
FIG. 19*c* is a fragmentary plan view of the planar overlay pattern of non-magnetic electrically conductive material comprising the lower metallization level as defined by the composite mask illustrated in FIG. 19*b*.

FIGS. **19*a*–19*c* illustrate a transfer gate region in a magnetic bubble memory device as fabricated in accordance with the present invention, wherein the second mask is of a composite type utilizing off-set alignment between elements of the upper overlay pattern 19' of permalloy and the patterned layer 21' of photoresist material. Thus, FIG. 19*a* illustrates the upper planar overlay pattern 19' of permalloy in the area of a typical transfer gate region. FIG. 19*b* shows in dashed lines the patterned layer of photoresist material 21' which is arranged in off-set alignment with respect to the patterned planar overlay 19' of permalloy. FIG. 19*c* illustrates the patterned lower metallization level 17 of non-magnetic electrically conductive material whose outline corresponds to the marginal edges of the patterned photoresist layer 21' and the permalloy elements 19' as depicted in FIG. 19*b*. In this respect, it will be observed that the space between the two elongated conductors 28, 29 of the hairpin loop element 30 included in the patterned lower metallization level 17 is determined at its narrowest dimension by the gap d between two spaced permalloy elements 19' in the manner of FIGS. 16–18. Furthermore, the two elongated conductors 28, 29 of the hairpin loop element 30 respectively comprise input and return spaced conductor members integrally connected to each other at only one end thereof to define a hairpin loop 31 of the substantially U-shaped hairpin element 30 as illustrated in FIG. 19*c*. This hairpin loop element 30 is similar in configuration and operation to the hairpin element as disclosed in U.S. Pat. No. 4,152,776 to Bullock et al issued on May 1, 1979, and the hairpin element disclosed in pending U.S. patent application, Ser. No. 888,124, filed Mar. 20, 1978 by Bullock, now U.S. Pat. No. 4,193,124 issued Mar. 11, 1980, for example, except that the marginal edge portions of overlying permalloy elements 19' are incorporated into the over-all shape thereof in accordance with the present invention. The input and return spaced conductor members 28 and 29 underlie respective different permalloy elements 19' (as indicated in FIG. 19***b* by the permalloy elements 19'*a* and 19'*b* which are spaced from each other). This arrangement allows a current path for an energy pulse applied to the input conductor member 28 of the control conductor comprising the hairpin loop element 30, wherein the current pulse travels through the input conductor member 28, about the hairpin loop region 31, and back via the return conductor member 29 in activating a bubble function-determining component of the upper overlay pattern 19' of permalloy. Thus, the particular design of the transfer gate regions and replicate output gate regions as well as other bubble function-determining components in the upper overlay permalloy pattern 19' is so configured as to avoid the formation of a shorting path in the lower overlay pattern of non-magnetic electrically conductive material which would prevent the proper functioning of the control conductors defined in the lower overlay pattern 17. The particular transfer gate region illustrated in FIGS. 19*a*–19*c* performs a true swap transfer function of the character more specifically described in the aforementioned U.S. Pat. No. 4,152,776 of Bullock et al., wherein data as represented by chains of magnetic bubbles and voids may be simultaneously exchanged between bubble propagation paths included in the bubble storage section and a bubble propagation path which may be either a major loop or a propagation path included in an input section of the magnetic bubble memory architecture. However, it will be understood that the transfer gate regions of magnetic bubble memory devices as constructed in accordance with the present invention may either define one-way transfer gates or two-way transfer gates between bubble propagation paths included in a bubble storage section and a major bubble propagation path which may comprise a major loop or simply an input bubble propagation path.

Figure 20A:
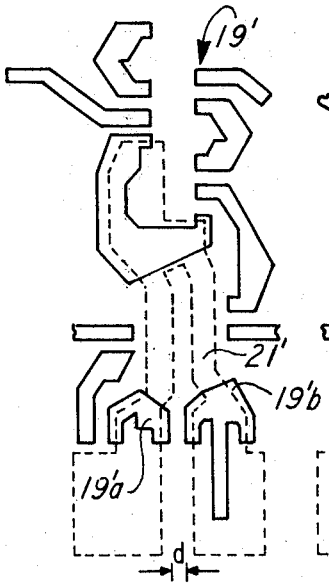
FIG. 20*a* is a fragmentary plan view of a planar swap gate structure in accordance with the present invention, wherein the offset photoresist pattern aligned therewith to define the composite second mask for patterning the non-magnetic electrically conductive material comprising the lower metallization level is shown in dashed lines.
Figure 20B:
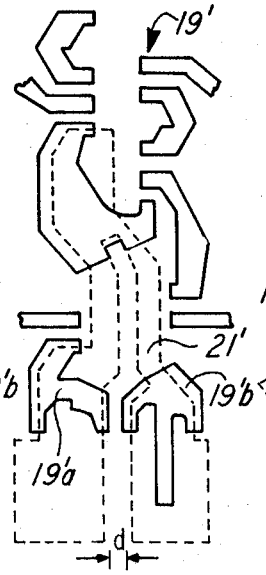
FIG. 20*b* is a fragmentary plan view of a planar swap gate with period compression, and showing the offset photoresist pattern aligned therewith in dashed lines to define the composite second mask for patterning the non-magnetic electrically conductive material comprising the lower metallization level.
Figure 20C:
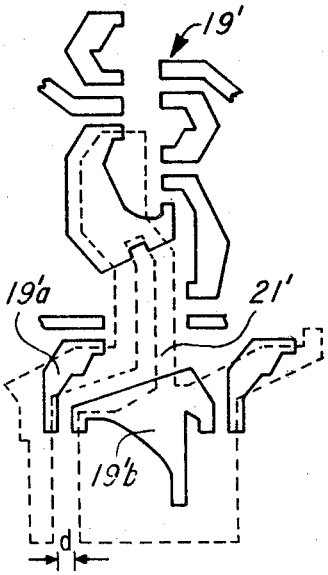
FIG. 20*c* is a fragmentary plan view of a planar pseudo swap gate having a double period element, with the offset photoresist pattern aligned therewith being shown in dashed lines to designate the composite second mask for patterning the non-magnetic electrically conductive material comprising the lower metallization level.

FIGS. 20*a*–20*c* are fragmentary illustrations of various types of planar transfer gate configurations of permalloy elements 19' as constructed in accordance with the present invention so as to insure the proper operation of the substantially U-shaped hairpin element as defined in the lower overlay pattern 17 of non-magnetic electrically conductive material. FIG. 20*a* corresponds to FIG. 19*b* in illustrating a plan view of a planar swap gate structure of permalloy elements 19' in accordance with the present invention, wherein the offset photoresist pattern 21' is shown in dashed lines so as to define the composite second mask therewith for patterning the non-magnetic electrically conductive material comprising the lower metallization level 17. FIGS. 20*b* and 20*c* disclose variations of a planar transfer gate structure. FIG. 20*b* is a true swap gate offering period compression, while FIG. 20*c* is a pseudo-swap gate offering a double period element in which exchange of data is accomplished in one clock cycle per storage loop. The latter feature forms no part of the present invention and is merely mentioned to show another configuration which the transfer gate may take in accordance with the present invention. What is important is that in each of the forms of the transfer gate structure respectively illustrated in FIGS. 20*a*–20*c*, the space between the two elongated conductors of the hairpin loop element included in the patterned lower metallization level 17 is determined at its narrowest dimension by the gap d between two spaced permalloy elements 19'. Also, in each instance, the upper overlay permalloy pattern 19' is so designed to provide for a lower overlay pattern 17' in which the individual control conductors include input and return spaced conductor members integrally connected to each other at only one end thereof to define a hairpin loop, with the input and return conductor members underlying respective different bubble propagation elements 19'*a* and 19'*b* of the overlay permalloy pattern 19' which are spaced from each other so that a proper current path is provided for an energy pulse applied to the input conductor member of each control conductor, as hereinbefore described.

Figures 21A, 21B, 21C:
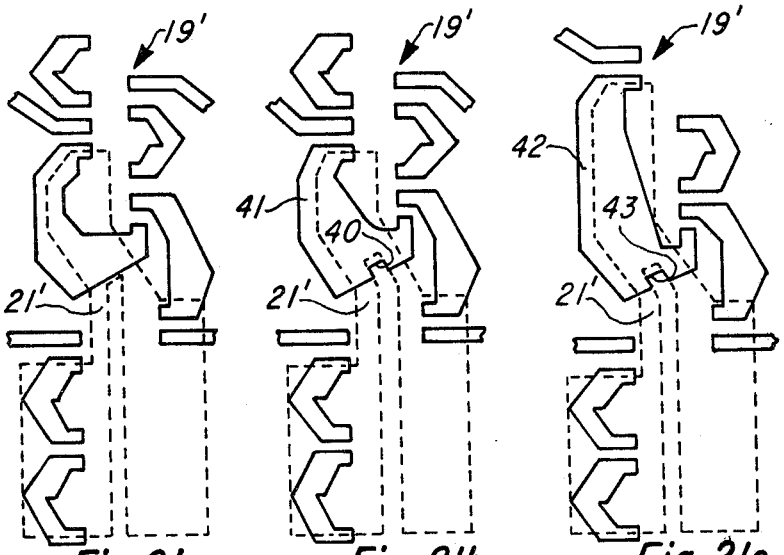
FIG. 21*a* is a fragmentary plan view of a planar replicate gate having the offset photoresist pattern aligned therewith shown in dashed lines.
FIG. 21*b* is a fragmentary plan view of a planar replicate gate having a notch in the hook-like element of the replicate gate, with the offset photoresist pattern aligned therewith being shown in dashed lines.
FIG. 21*c* is a planar replicate gate structure providing for increased bubble stretching during the replicate operation and showing the offset photoresist pattern aligned therewith in dashed lines.

FIGS. 21*a*–21*c* respectively illustrate plan views of planar output replicate gate regions of the upper overlay pattern 19' of permalloy, with the offset photoresist pattern 21' aligned therewith being shown in dashed lines. As before, it will be understood that the configuration of the control conductor defined in the lower patterned overlay 17 of non-magnetic electrically conductive material will take the form outlined by marginal edge portions of the permalloy elements 19' and the photoresist pattern 21'. The output replicate gates of FIGS. 21*a* and 21*b* generally correspond to the output replicate gates as disclosed in the previously mentioned U.S. Pat. No. 4,193,124. The output replicate gate of FIG. 21*b* has a notch 40 formed in the hook-like transfer/replicate element 41 of the overlay permalloy pattern 19' which forms a bight at the end of a data storage loop. The notch 40 is formed in the transfer/replicate element 41 of the upper overlay permalloy pattern 19' in order to permit the formation of a corresponding notch in the loop region of the hairpin loop element defined as a control conductor in the lower overlay pattern 17 of aluminum-copper alloy during the subsequent patterning thereof. In this respect, the marginal edges of the transfer/replicate permalloy element 41 defining the notch 40 therein are included as part of the composite second mask and further define a corresponding notch in the hairpin loop element of the lower metallization level 17 during its patterning. The presence of this notch in the hairpin loop element improves the operation of the bubble replicating function in the output replicate gate regions of the magnetic bubble memory device. The hook-like transfer/replicate permalloy element 42 of FIG. 21*c* has a similar notch 43 formed therein for the same reason.

Figure 22:
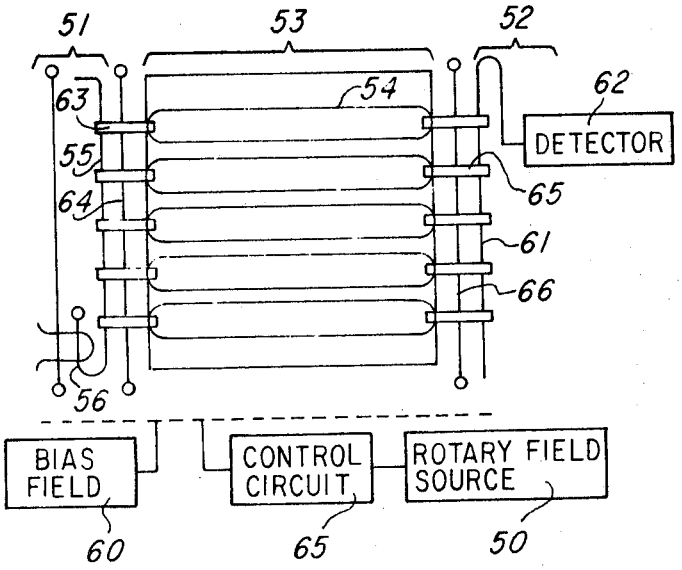
FIG. 22 is a diagrammatic view of the architecture of a magnetic bubble memory chip which may be fabricated in accordance with the present invention.

By way of example, FIG. 22 diagrammatically illustrates a block replicate chip architecture for a magnetic bubble memory device as fabricated in accordance with the present invention. In this instance, a bubble propagation path pattern is disposed on the layer of magnetic bubble-supporting material 11 (not shown) for guiding the movement of the bubbles in the layer 11 in response to a change in orientation of a rotary magnetic field within the plane of the magnetic layer 11, the rotary in-plane magnetic field being provided from a rotary field source 50. The bubble propagation path pattern comprises a planar overlay pattern of magnetically soft material, e.g. permalloy, as disposed on a major surface of the planar magnetic layer 11. As shown in FIG. 22, this planar permalloy overlay pattern is generally arranged to include a bubble input section 51, a bubble output section 52, and an intermediate bubble storage section 53 disposed between the bubble input section 51 and the bubble output section 52. The bubble input section 51 and the bubble output section 52 comprise major bubble propagation paths, while the intermediate bubble storage section 53 comprises a plurality of minor bubble propagation paths in the form of individual closed bubble storage loops 54. The bubble input section 51 includes a major propagation path 55 having a bubble generator 56 thereon. The bubble generator 56 will produce a bubble at each complete rotation of the in-plane magnetic drive field derived from the field source 50 for propagation along the major propagation path 55 included in the bubble input section 51. The diameter of the individual magnetic bubble domains is determined by a magnetic bias field supplied by a source 60 and applied substantially perpendicularly to the chip. As herein contemplated, a bubble diameter of 2 micron size may be employed in the operation of the magnetic bubble memory chip as fabricated in accordance with the present invention.

The bubble output section 52 includes a major propagation path 61 communicating with a detector 62 for sensing the presence or absence of magnetic bubbles delivered thereto via the major propagation path 61. Transfer gates 63 corresponding in number to the storage loops 54 are operably interconnected with the storage loops 54 at one end thereof and with the major propagation path 55 of the bubble input section 51 by virtue of a control line 64 leading to a pulse generator. By properly pulsing the control line 64 via a control circuit 65 including a variable pulse generator, data transfer may be effected from the bubble input section 51 to the bubble storage section 53 through the transfer gates 63. Where the transfer gates 63 are of the true swap character disclosed in U.S. Pat. No. 4,152,776 to Bullock et al, simultaneous data interchange may be effected, wherein data from the bubble storage section 53 is simultaneously transferred to the bubble propagation path 55 of the bubble input section 51. In a similar manner, a plurality of replicate/transfer output gates 65 are provided between each of the respective storage loops 54 at the opposite end thereof and the major propagation path 61 of the bubble output section 52. The plurality of output replicate gates 65 are operably interconnected by a control line 66 which is connected to the control circuit 65. The variable pulse generator included in the control circuit 65 can effectively produce a predetermined pulse of a different width as compared to the pulse required to activate the transfer gates 63 for activating the respective replicate/transfer output gates 65 in the manner generally described in U.S. Pat. No. 4,152,776 to Bullock et al. In accordance with the fabrication method herein disclosed, the regions of the upper overlay permalloy pattern defining the transfer gates 63 and the output replicate gates 65 are planar, thereby eliminating magnetic field anomalies and contributing to the reliable operation of a magnetic bubble memory device, wherein the bubble propagation elements and bubble function-determining components defined by the upper overlay permalloy pattern are of reduced geometry size to accommodate 2 micron bubble operation. While the form of the magnetic bubble memory chip architecture illustrated in FIG. 22 is of the block replicate type, it will be understood that major-minor loop architectures can likewise be fabricated by the top-down planar process disclosed herein.

The improved top-down planar process of fabricating a magnetic bubble memory device can be practiced using commercially available photoresist materials and standard photolithographic techniques in patterning the photoresist. The consecutive deposition of 3000 Å AlCu, 2000 Å $SiO_2$ and 4000 Å permalloy is accomplished in a single pump down cycle by suitable deposition techniques. The composite second mask herein described provides the pattern defining the oxide and aluminum-copper layers which are respectively patterned by two different plasma etches. As specific examples, the plasma etch employed for patterning the oxide layer 18 comprised a gaseous mixture of approximately 65 ccm $C_2F_6$ and 100 ccm Ar; pressure-800 microns; power-400 watts; electrode spacing 0.25–0.35″; chamber platen-16″ diameter; rate of oxide removal (thermal $SiO_2$)>200 Å/min. The aluminum-copper plasma etch comprised a gaseous atmosphere of 250 ccm of $SiCl_4$; pressure-300 microns; power 500–600 watts; electrode spacing 0.25–0.35″; chamber platen-16″ diameter; rate of AlCu removal 1500 Å/min. The top-down planar process may be accomplished sequentially in a single radial-flow reactor with some relaxation of design tolerances by virtue of employing portions of the upper overlay permalloy pattern in the composite second mask to delineate all critical pattern features in the underlying lower overlay of aluminum-copper alloy. The selectivity of the respective plasma etches for patterning the oxide layer 18 and the aluminum-copper alloy layer 17 is excellent, thereby enabling the process to fabricate a self-aligned design using the previously patterned upper metallization level of permalloy to mask part of the underlying aluminum-copper alloy metallization level.

While particular embodiments of the invention have been shown and described, it will be understood that variations and modifications thereof can be made within the scope of the invention by those skilled in the art. Therefore, it is intended that the appended claims be interpreted as broadly as reasonably permitted by the prior art to include all such variations and modifications within the scope of the present invention.

What is claimed is:

1. In a method of fabricating a magnetic bubble memory device, the steps comprising:

consecutively depositing onto a substrate having a magnetic film capable of supporting magnetic bubbles therein, at least the following a planar layer of non-magnetic electrically conductive material;

a planar layer of insulating material; and a planar layer of magnetically soft material; and proceeding from the uppermost layer downwardly, patterning each of the respective layers in sequence, by initially forming a first pattern mask on the layer of magnetically soft material which selectively exposes regions thereof;

patterning the layer of magnetically soft material to provide a planar overlay pattern thereof by selectively removing the exposed regions of the layer of magnetically soft material to uncover corresponding regions of the layer of insulating material;

removing the first pattern mask to expose the remaining portions of the layer of magnetically soft material as a planar overlay pattern;

patterning the layers of insulating material and non-magnetic electrically conductive material in sequence by depositing a layer of photosensitive material covering the planar overlay pattern of magnetically soft material and the exposed portion of the layer of insulating material;

selectively exposing the layer of photosensitive material to an energy source to impart a latent image therein;

developing the photosensitive material to form a second pattern mask exposing at least selected regions of the layer of insulating material;

selectively removing the exposed regions of the layer of insulating material; and thereafter selectively removing the corresponding regions of the layer of non-magnetic electrically conductive material beneath the previously removed exposed regions of the layer of insulating material such that the patterned non-magnetic electrically conductive layer underlies the entire surface area of the planar overlay pattern of magnetically soft material in insulated relationship with respect thereto.

2. A method as set forth in claim 1, wherein the layer of non-magnetic electrically conductive material is deposited onto the bubble-supporting magnetic film in direct contact therewith.

3. A method as set forth in claim 1, wherein the consecutive deposition of respective layers onto the substrate having the bubble-supporting magnetic film initially includes the deposition of a first layer of insulating material in direct contact with the bubble-supporting magnetic film.

4. A method as set forth in claim 1, wherein the layer of magnetically soft material is patterned by ion milling.

5. A method as set forth in claim 1, wherein the first pattern mask is formed on the layer of magnetically soft material by applying a layer of photosensitive material thereto;

selectively exposing the layer of photosensitive material to an energy source to define a latent image therein;

developing the layer of photosensitive material and removing portions therefrom to define the first pattern mask selectively exposing regions of the layer of magnetically soft material;

and the patterning of the layer of magnetically soft material is accomplished by ion milling the exposed regions thereof.

6. A method as set forth in claim 5, wherein the removal of corresponding regions of the layer of insulating material and the underlying layer of non-magnetic electrically conductive material is accomplished by sequential plasma etching employing different selective plasma etches for the layer of insulating material and the layer of non-magnetic electrically conductive material.

7. In a method of fabricating a magnetic bubble memory device, the steps comprising:

consecutively depositing onto a substrate having a magnetic film capable of supporting magnetic bubbles therein, at least the following a planar layer of non-magnetic electrically conductive material;

a planar layer of insulating material; and a planar layer of magnetically soft material; and proceeding from the uppermost layer downwardly, patterning each of the respective layers in sequence, by initially forming a first pattern mask on the layer of magnetically soft material which selectively exposes regions thereof;

patterning the layer of magnetically soft material to provide a planar overlay pattern thereof by selectively removing the exposed regions of the layer of magnetically soft material to uncover corresponding regions of the layer of insulating material; and removing the first pattern mask to expose the remaining portions of the layer of magnetically soft material as a planar overlay pattern;

patterning the layers of insulating material and non-magnetic electrically conductive material in sequence by depositing a layer of photosensitive material covering the planar overlay pattern of magnetically soft material and the exposed portion of the layer of insulating material;

selectively exposing the layer of photosensitive material to an energy source to impart a latent image therein arranged in offset relationship to the planar overlay pattern of magnetically soft material;

developing the photosensitive material to define a pattern disposed in offset relationship to the planar overlay pattern of magnetically soft material exposing at least selected regions of the planar overlay pattern of magnetically soft material and selected regions of the layer of insulating material wherein the selectively exposed regions of the planar overlay pattern of magnetically soft material cooperate with the patterned offset photosensitive layer to form a composite second pattern mask;

selectively removing the exposed regions of the layer of insulating material in conformance to the composite second pattern mask; and thereafter selectively removing the corresponding regions of the layer of non-magnetic, electrically conductive material beneath the previously removed exposed regions of the layer of insulating material such that the patterned non-magnetic electrically conductive layer underlies the entire surface area of the planar overlay pattern of magnetically soft material in insulated relationship with respect thereto.

8. A method as set forth in claim 7, wherein the definition of the critical pattern areas in the patterning of the layer of non-magnetic electrically conductive material is provided solely by portions of the planar overlay pattern of magnetically soft material included in the composite second pattern mask.

9. A method as set forth in claim 8, wherein the layer of non-magnetic electrically conductive material is deposited onto the bubble-supporting magnetic film in direct contact therewith.

10. A method as set forth in claim 8, wherein the consecutive deposition of respective layers onto the substrate having the bubble-supporting magnetic film initially includes the deposition of a first layer of insulating material in direct contact with the bubble-supporting magnetic film.

11. A method as set forth in claim 8, wherein the layer of magnetically soft material is patterned by ion milling.

12. A method as set forth in claim 8, wherein the first pattern mask is formed on the layer of magnetically soft material by applying a layer of photosensitive material thereto;

selectively exposing the layer of photosensitive material to an energy source to define a latent image therein;

developing the layer of photosensitive material and removing portions therefrom to define the first pattern mask selectively exposing regions of the layer of magnetically soft material;

and the patterning of the layer of magnetically soft material is accomplished by ion milling the exposed regions thereof.

13. A method as set forth in claim 12, wherein the removal of corresponding regions of the layer of insulating material and the underlying layer of non-magnetic electrically conductive material is accomplished by sequential plasma etching employing different selective plasma etches for the layer of insulating material and the layer of non-magnetic electrically conductive material.

14. A method as set forth in any one of claims 1, 2, 3, 6, 7, 8, 9, 10 or 13, wherein the selective removal of the corresponding regions of the layer of non-magnetic electrically conductive material beneath the previously removed exposed regions of the layer of insulating material is conducted to provide a different pattern in the non-magnetic electrically conductive layer as compared to the pattern of the planar overlay of magnetically soft material whose entire surface area is underlain by the patterned non-magnetic electrically conductive layer in insulated relationship with respect thereto.

15. A method as set forth in claim 14 wherein the selective removal of the corresponding regions of the layer of non-magnetic electrically conductive material beneath the previously removed exposed regions of the layer of insulating material is conducted to retain a portion of the patterned layer of non-magnetic electrically conductive material as a conductive pattern free from vertical registration with the planar overlay pattern of magnetically soft material.

* * * * *